US005826222A

United States Patent [19]

Griffin

[11] Patent Number: 5,826,222

[45] Date of Patent: Oct. 20, 1998

[54] ESTIMATION OF EXCITATION PARAMETERS

[75] Inventor: Daniel Wayne Griffin, Hollis, N.H.

[73] Assignee: Digital Voice Systems, Inc., Burlington, Mass.

[21] Appl. No.: 834,145

[22] Filed: Apr. 14, 1997

Related U.S. Application Data

[63] Continuation of Ser. No. 371,743, Jan. 12, 1995, abandoned.

[51] Int. Cl.[6] ..... G10L 9/04

[52] U.S. Cl. ..... 704/207; 704/208; 704/209; 704/226; 704/229

[58] Field of Search ..... 704/207, 208, 704/209, 226, 229

[56] References Cited

U.S. PATENT DOCUMENTS

| | | | |
|---|---|---|---|
| 3,706,929 | 12/1972 | Robinson et al. | 381/38 |
| 3,975,587 | 8/1976 | Dunn et al. | 179/1 SA |
| 3,982,070 | 9/1976 | Flanagan | 179/1 SM |
| 3,995,116 | 11/1976 | Flanagan | 179/1 SM |
| 4,004,096 | 1/1977 | Bauer et al. | 381/49 |
| 4,015,088 | 3/1977 | Dubnowski et al. | 179/15 A |
| 4,074,228 | 2/1978 | Jonscher | 340/146.1 AQ |
| 4,076,958 | 2/1978 | Fulghum | 381/51 |
| 4,091,237 | 5/1978 | Wolnowsky et al. | 179/1 SC |
| 4,441,200 | 4/1984 | Fette et al. | 395/2 |
| 4,618,982 | 10/1986 | Horvath et al. | 381/36 |
| 4,622,680 | 11/1986 | Zinser | 375/25 |
| 4,672,669 | 6/1987 | Des Blache et al. | 381/46 |
| 4,696,038 | 9/1987 | Doddington et al. | 381/38 |
| 4,720,861 | 1/1988 | Bertrand | 381/36 |
| 4,797,926 | 1/1989 | Bronson et al. | 381/36 |
| 4,799,059 | 1/1989 | Grindahl et al. | 340/870.03 |
| 4,809,334 | 2/1989 | Bhaskar | 381/49 |
| 4,813,075 | 3/1989 | Ney | 381/43 |
| 4,879,748 | 11/1989 | Picone et al. | 381/49 |
| 4,885,790 | 12/1989 | McAulay et al. | 381/36 |
| 4,989,247 | 1/1991 | Van Hemert | 381/41 |
| 5,023,910 | 6/1991 | Thomson | 381/37 |
| 5,036,515 | 7/1991 | Freeburg | 371/5.1 |
| 5,054,072 | 10/1991 | McAulay et al. | 381/31 |
| 5,067,158 | 11/1991 | Arjmand | 381/51 |

(List continued on next page.)

FOREIGN PATENT DOCUMENTS

| | | | |
|---|---|---|---|
| 0 123 456 | 10/1984 | European Pat. Off. . | |
| 154381 | 9/1985 | European Pat. Off. | G10L 3/00 |
| 0 303 312 | 2/1989 | European Pat. Off. . | |
| WO 88/07740 | 10/1988 | WIPO . | |
| WO 92/05539 | 4/1992 | WIPO . | |
| WO 92/10830 | 6/1992 | WIPO . | |

OTHER PUBLICATIONS

Deller, Proakis, Hansen; "Discrete–time processing of speech signals", 1993, Macmillan Publishing Company, p. 460, paragraph 7.4.1; p. 461; figure 7.25.

(List continued on next page.)

*Primary Examiner*—David R. Hudspeth
*Assistant Examiner*—Vijay B. Chawan
*Attorney, Agent, or Firm*—Fish & Richardson, P.C.

[57] ABSTRACT

A method of encoding speech by analyzing a digitized speech signal to determine excitation parameters for the digitized speech signal is disclosed. The method includes dividing the digitized speech signal into at least two frequency bands, determining a first preliminary excitation parameter by performing a nonlinear operation on at least one of the frequency band signals to produce a modified frequency band signal and determining the first preliminary excitation parameter using the modified frequency band signal, determining a second preliminary excitation parameter using a method different from the first method, and using the first and second preliminary excitation parameters to determine an excitation parameter for the digitized speech signal. The method is useful in encoding speech. Speech synthesized using the parameters estimated based on the invention generates high quality speech at various bit rates useful for applications such as satellite voice communication.

41 Claims, 3 Drawing Sheets

U.S. PATENT DOCUMENTS

| | | | |
|---|---|---|---|
| 5,081,681 | 1/1992 | Hardwick | 381/17 |
| 5,091,944 | 2/1992 | Takahashi | 381/36 |
| 5,091,946 | 2/1992 | Ozawa | 381/36 |
| 5,095,392 | 3/1992 | Shimazaki et al. | 360/40 |
| 5,195,166 | 3/1993 | Hardwick et al. | 395/2 |
| 5,216,747 | 6/1993 | Hardwick et al. | 395/2 |
| 5,226,084 | 7/1993 | Hardwick et al. | 381/41 |
| 5,226,108 | 7/1993 | Hardwick et al. | 381/47 |
| 5,247,579 | 9/1993 | Hardwick et al. | 371/40 |
| 5,265,167 | 11/1993 | Akamine et al. | 381/40 |
| 5,504,833 | 4/1996 | George et al. | 395/2.2 |
| 5,517,511 | 5/1996 | Hardwick et al. | 371/37.4 |

OTHER PUBLICATIONS

Kurematsu, et al., "A Linear Predictive Vocoder With New Pitch Extraction and Exciting Source"; 1979 IEEE International Conference on Acoustics; pp. 69–72.

Kurbsack, et al.; "An Autocorrelation Pitch Detector and Voicing Decision with Confidence Measures Developed for Noise–Corrupted Speech"; Feb. 1991; IEEE; vol. 39, No. 2; pp. 319–321.

Cox et al., "Subband Speech Coding and Matched Convolutional Channel Coding for Mobile Radio Channels," IEEE Trans. Signal Proc., vol. 39, No. 8 ( Aug. 1991), pp. 1717–1731.

Digital Voice Systems, Inc., "The DVSI IMBE Speech Compression System," advertising brochure (May 12, 1993).

Digital Voice Systems, Inc., "The DVSI IMBE Speech Coder," advertising brochure (May 12, 1993).

Fujimura, "An Approximation to Voice Aperiodicity", IEEE Transactions on Audio and Electroacoutics, vol. AU–16, No. 1 (Mar. 1968), pp. 68–72.

Griffin, "The Multiband Excitation Vocoder", Ph.D. Thesis, M.I.T., 1987.

Hardwick et al. "The Application of the IMBE Speech Coder to Mobile Communications," IEEE (1991), pp. 249–252.

Heron, "A 32–Band Sub–band/Transform Coder Incorporating Vector Quantization for Dynamic Bit Allocation", IEEE (1983), pp. 1276–1279.

Makhoul, "A Mixed–Source Model For Speech Compression and Synthesis", IEEE (1978), pp. 163–166.

Maragos et al., "Speech Nonlinearities, Modulations, and Energy Operators", IEEE (1991), pp. 421–424.

McCree et al., "A New Mixed Excitation LPC Vocoder", IEEE (1991), pp. 593–595.

McCree et al., "Improving The Performance Of A Mixed Excitation LPC Vocoder In Acoustic Noise", IEEE (1992), pp. 137–139.

Quackenbush et al., "The Estimation and Evaluation Of Pointwise Nonlinearities For Improving The Performance Of Objective Speech Quality Measures", IEEE (1983), pp. 547–550.

Hardwick ("A 4.8 Kbps Multi–Band Excitation Speech Coder", Massachusetts Institute of Technology, May 1988, pp. 1–68).

Hess, Wolfgang J., ("Pitch and Voicing Determination", Advances in Speech Signal Processing, Eds. Sadaoki Furui & M.Mohan Sondhi, Marcel Dekker, Inc., Jan. 1991, pp. 1–48).

Quatieri, et al. "Speech Transformation Based on A Sinusoidal Representation", IEEE, TASSP, vol., ASSP34 No. 6, Dec. 1986, pp. 1449–1464.

Griffin, et al., "A High Quality 9.6 Kbps Speech Coding System", Proc. ICASSP 86, pp. 125–128, Tokyo, Japan, Apr. 13–20, 1986.

Griffin et al., "A New Model–Based Speech Analysis/Synthesis System", Proc. ICASSP 85 pp. 513–516, Tampa. FL., Mar. 26–29, 1985.

Hardwick, "A 4.8 kbps Multi–Band Excitation Speech Coder", S.M. Thesis, M.I.T, May 1988.

McAulay et al., "Mid–Rate Coding Based on a Sinusoidal Representation of Speech", Proc. IEEE 1985 pp. 945–948.

Hardwick et al. "A 4.8 Kbps Multi–band Excitation Speech Coder, " Proceedings from ICASSP, International Conference on Acoustics, Speech and Signal Processing, New York, N.Y., Apr. 11–14, pp. 374–377 (1988).

Griffin et al., "Multiband Excitation Vocoder" IEEE Transactions on Acoustics, Speech and Signal Processing, vol. 36, No. 8, pp. 1223–1235 (1988).

Almeida et al., "Harmonic Coding: A Low Bit–Rate, Good–Quality Speech Coding Technique," IEEE (CH 1746–7/82/0000 1684) pp. 1664–1667 (1982).

Tribolet et al., "Frequency Domain Coding of Speech," IEEE Transactions on Acoustics, Speech and Signal Processing, V. ASSP–27, No. 5, pp. 512–530 (Oct. 1979).

McAulay et al., "Speech Analysis/Synthesis Based on A Sinusoidal Representation," IEEE Transactions on Acoustics, Speech and Signal Processing V. 34, No. 4, pp. 744–754, (Aug. 1986).

Griffin, et al. "A New Pitch Detection Algorithm", Digital Signal Processing, No. 84, pp. 395–399.

McAulay, et al., "Computationally Efficient Sine–Wave Synthesis and Its Application to Sinusoidal Transform Coding", IEEE 1988, pp. 370–373.

Portnoff, Short–Time Fourier Analysis of Sampled Speech, IEEE Transactions on Acoustics, Speech, and Signal Processing, vol. ASSP–29, No. 3, Jun. 1981, pp. 324–333.

Griffin et al. "Signal Estimation from modified Short t–Time Fourier Transform", IEEE Transactions on Acoustics, Speech, and Signal Processing, vol. ASSP–32, No. 2, Apr. 1984, pp. 236–243.

Almeida, et al. "Variable–Frequency Synthesis; An Improved Harmonic Coding Scheme", ICASSP 1984 pp. 27.5.1–27.5.4.

Flanagan, J.L., Speech Analysis Synthesis and Perception, Springer–Verlag, 1982, pp. 378–386.

Secrest, et al., "Postprocessing Techniques for Voice Pitch Trackers", ICASSP, vol. 1, 1982, pp. 171–175.

Patent Abstracts of Japan, vol. 14, No. 498 (P–1124), Oct. 30, 1990.

Mazor et al., "Transform Subbands Coding With Channel Error Control", IEEE 1989, pp. 172–175.

Brandstein et al., "A Real–Time Implementation of the Improved MBE Speech Coder", IEEE 1990, pp. 5–8.

Levesque et al., "A Proposed Federal Standard for Narrowband Digital Land Mobile Radio", IEEE 1990, pp. 497–501.

Yu et al., "Discriminant Analysis and Supervised Vector Quantization for Continuous Speech Recognition", IEEE 1990, pp. 685–688.

Jayant et al., *Digital Coding of Waveform*, Prentice–Hall, 1984.

Atungsiri et al., "Error Detection and Control for the Parametric Information in CELP Coders", IEEE 1990, pp. 229–232.

Digital Voice Systems, Inc., "Inmarsat–M Voice Coder", Version 1.9, Nov. 18, 1992.

Campbell et al., "The New 4800 bps Voice Coding Standard", Mil Speech Tech Conference, Nov. 1989.

Chen et al., "Real–Time Vector APC Speech Coding at 4800 bps with Adaptive Postfiltering", Proc. ICASSP 1987, pp. 2185–2188.

Jayant et al., "Adaptive Postfiltering of 16 kb/s–ADPCM Speech", Proc. ICASSP 86, Tokyo, Japan, Apr. 13–20, 1986, pp. 829–832.

Makhoul et al., "Vector Quantization in Speech Coding", Proc. IEEE, 1985, pp. 1551–1588.

Rahikka et al., "CELP Coding for Land Mobile Radio Applications," Proc. ICASSP 90, Albuquerque, New Mexico, Apr. 3–6, 1990, pp. 465–468.

ESTIMATION OF EXCITATION PARAMETERS

This application is a continuation of U.S. application Ser. No. 08/371,743, filed Jan. 12, 1995, now abandoned.

BACKGROUND OF THE INVENTION

The invention relates to improving the accuracy with which excitation parameters are estimated in speech analysis and synthesis.

Speech analysis and synthesis are widely used in applications such as telecommunications and voice recognition. A vocoder, which is a type of speech analysis/synthesis system, models speech as the response of a system to excitation over short time intervals. Examples of vocoder systems include linear prediction vocoders, homomorphic vocoders, channel vocoders, sinusoidal transform coders ("STC"), multiband excitation ("MBE") vocoders, improved multiband excitation ("IMBE (TM)") vocoders.

Vocoders typically synthesize speech based on excitation parameters and system parameters. Typically, an input signal is segmented using, for example, a Hamming window. Then, for each segment, system parameters and excitation parameters are determined. System parameters include the spectral envelope or the impulse response of the system. Excitation parameters include a fundamental frequency (or pitch) and a voiced/unvoiced parameter that indicates whether the input signal has pitch (or indicates the degree to which the input signal has pitch). In vocoders that divide the speech into frequency bands, such as IMBE (TM) vocoders, the excitation parameters may also include a voiced/unvoiced parameter for each frequency band rather than a single voiced/unvoiced parameter. Accurate excitation parameters are essential for high quality speech synthesis.

When the voiced/unvoiced parameters include only a single voiced/unvoiced decision for the entire frequency band, the synthesized speech tends to have a "buzzy" quality especially noticeable in regions of speech which contain mixed voicing or in voiced regions of noisy speech. A number of mixed excitation models have been proposed as potential solutions to the problem of "buzziness" in vocoders. In these models, periodic and noise-like excitations are mixed which have either time-invariant or time-varying spectral shapes.

In excitation models having time-invariant spectral shapes, the excitation signal consists of the sum of a periodic source and a noise source with fixed spectral envelopes. The mixture ratio controls the relative amplitudes of the periodic and noise sources. Examples of such models include Itakura and Saito, "Analysis Synthesis Telephony Based upon the Maximum Likelihood Method," Reports of 6th Int. Cong. Acoust., Tokyo, Japan, Paper C-5-5, pp. C17–20, 1968; and Kwon and Goldberg, "An Enhanced LPC Vocoder with No Voiced/Unvoiced Switch," IEEE Trans. on Acoust., Speech, and Signal Processing, vol. ASSP-32, no. 4, pp. 851–858, August 1984. In theses excitation models a white noise source is added to a white periodic source. The mixture ratio between these sources is estimated from the height of the peak of the autocorrelation of the LPC residual.

In excitation models having time-varying spectral shapes, the excitation signal consists of the sum of a periodic source and a noise source with time varying spectral envelope shapes. Examples of such models include Fujimara, "An Approximation to Voice Aperiodicity," IEEE Trans. Audio and Electroacoust., pp. 68–72, March 1968; Makhoul et al., "A Mixed-Source Excitation Model for Speech Compression and Synthesis," IEEE Int. Conf. on Acoust. Sp. & Sig. Proc., April 1978, pp. 163–166; Kwon and Goldberg, "An Enhanced LPC Vocoder with No Voiced/Unvoiced Switch," IEEE Trans. on Acoust., Speech, and Signal Processing, vol. ASSP-32, no.4, pp. 851–858, August 1984; and Griffin and Lim, "Multiband Excitation Vocoder," IEEE Trans. Acoust., Speech, Signal Processing, vol. ASSP-36, pp. 1223–1235, August 1988.

In the excitation model proposed by Fujimara, the excitation spectrum is divided into three fixed frequency bands. A separate cepstral analysis is performed for each frequency band and a voiced/unvoiced decision for each frequency band is made based on the height of the cepstrum peak as a measure of periodicity.

In the excitation model proposed by Makhoul et al., the excitation signal consists of the sum of a low-pass periodic source and a high-pass noise source. The low-pass periodic source is generated by filtering a white pulse source with a variable cut-off low-pass filter. Similarly, the high-pass noise source was generated by filtering a white noise source with a variable cut-off high-pass filter. The cut-off frequencies for the two filters are equal and are estimated by choosing the highest frequency at which the spectrum is periodic. Periodicity of the spectrum is determined by examining the separation between consecutive peaks and determining whether the separations are the same, within some tolerance level.

In a second excitation model implemented by Kwon and Goldberg, a pulse source is passed through a variable gain low-pass filter and added to itself, and a white noise source is passed through a variable gain high-pass filter and added to itself. The excitation signal is the sum of the resultant pulse and noise sources with the relative amplitudes controlled by a voiced/unvoiced mixture ratio. The filter gains and voiced/unvoiced mixture ratio are estimated from the LPC residual signal with the constraint that the spectral envelope of the resultant excitation signal is flat.

In the multiband excitation model proposed by Griffin and Lim, a frequency dependent voiced/unvoiced mixture function is proposed. This model is restricted to a frequency dependent binary voiced/unvoiced decision for coding purposes. A further restriction of this model divides the spectrum into a finite number of frequency bands with a binary voiced/unvoiced decision for each band. The voiced/unvoiced information is estimated by comparing the speech spectrum to the closest periodic spectrum. When the error is below a threshold, the band is marked voiced, otherwise, the band is marked unvoiced.

Excitation parameters may also be used in applications, such as speech recognition, where no speech synthesis is required. Once again, the accuracy of the excitation parameters directly affects the performance of such a system.

SUMMARY OF THE INVENTION

In one aspect, generally, the invention features a hybrid excitation parameter estimation technique that produces two sets of excitation parameters for a speech signal using two different approaches and combines the two sets to produce a single set of excitation parameters. In a first approach, the technique applies a nonlinear operation to the speech signal to emphasize the fundamental frequency of the speech signal. In a second approach, we use a different method which may or may not include a nonlinear operation. While the first approach produces highly accurate excitation parameters under most conditions, the second approach produces more accurate parameters under certain conditions.

By using both approaches and combining the resulting sets of excitation parameters to produce a single set, the technique of the invention produces accurate results under a wider range of conditions than are produced by either of the approaches individually.

In typical approaches to determining excitation parameters, an analog speech signal s(t) is sampled to produce a speech signal s(n). Speech signal s(n) is then multiplied by a window w(n) to produce a windowed signal $s_w(n)$ that is commonly referred to as a speech segment or a speech frame. A Fourier transform is then performed on windowed signal $s_w(n)$ to produce a frequency spectrum $S_w(\omega)$ from which the excitation parameters are determined.

When speech signal s(n) is periodic with a fundamental frequency $\omega_o$ or pitch period $n_o$ (where $n_o$ equals $2\pi/\omega_o$) the frequency spectrum of speech signal s(n) should be a line spectrum with energy at $\omega_o$ and harmonics thereof (integral multiples of $\omega_o$). As expected, $S_w(\omega)$ has spectral peaks that are centered around $\omega_o$ and its harmonics. However, due to the windowing operation, the spectral peaks include some width, where the width depends on the length and shape of window w(n) and tends to decrease as the length of window w(n) increases. This window-induced error reduces the accuracy of the excitation parameters. Thus, to decrease the width of the spectral peaks, and to thereby increase the accuracy of the excitation parameters, the length of window w(n) should be made as long as possible.

The maximum useful length of window w(n) is limited. Speech signals are not stationary signals, and instead have fundamental frequencies that change over time. To obtain meaningful excitation parameters, an analyzed speech segment must have a substantially unchanged fundamental frequency. Thus, the length of window w(n) must be short enough to ensure that the fundamental frequency will not change significantly within the window.

In addition to limiting the maximum length of window w(n), a changing fundamental frequency tends to broaden the spectral peaks. This broadening effect increases with increasing frequency. For example, if the fundamental frequency changes by $\Delta\omega_o$ during the window, the frequency of the mth harmonic, which has a frequency of $m\omega_o$, changes by $m\Delta\omega_o$ so that the spectral peak corresponding to $m\omega_o$ is broadened more than the spectral peak corresponding to $\omega_o$. This increased broadening of the higher harmonics reduces the effectiveness of higher harmonics in the estimation of the fundamental frequency and the generation of voiced/unvoiced parameters for high frequency bands.

By applying a nonlinear operation to the speech signal, the increased impact on higher harmonics of a changing fundamental frequency is reduced or eliminated, and higher harmonics perform better in estimation of the fundamental frequency and determination of voiced/unvoiced parameters. Suitable nonlinear operations map from complex (or real) to real values and produce outputs that are nondecreasing functions of the magnitudes of the complex (or real) values. Such operations include, for example, the absolute value, the absolute value squared, the absolute value raised to some other power, or the log of the absolute value.

Nonlinear operations tend to produce output signals having spectral peaks at the fundamental frequencies of their input signals. This is true even when an input signal does not have a spectral peak at the fundamental frequency. For example, if a bandpass filter that only passes frequencies in the range between the third and fifth harmonics of $\omega_o$ is applied to a speech signal s(n), the output of the bandpass filter, x(n), will have spectral peaks at $3\omega_o$, $4\omega_o$ and $5\omega_o$.

Though x(n) does not have a spectral peak at $\omega_o$, $|x(n)|^2$ will have such a peak. For a real signal x(n), $|x(n)|^2$ is equivalent to $x^2(n)$. As is well known, the Fourier transform of $x^2(n)$ is the convolution of $X(\omega)$, the Fourier transform of x(n), with $X(\omega)$:

$$\sum_{n=-\infty}^{\infty} x^2(n)e^{-j\omega n} = \frac{1}{2\pi}\int_{u=-\pi}^{\pi} X(\omega-u)X(u)du.$$

The convolution of $X(\omega)$ with $X(\omega)$ has spectral peaks at frequencies equal to the differences between the frequencies for which $X(\omega)$ has spectral peaks. The differences between the spectral peaks of a periodic signal are the fundamental frequency and its multiples. Thus, in the example in which $X(\omega)$ has spectral peaks at $3\omega_o 4\omega_o$ and $5\omega_o$, $X(\omega)$ convolved with $X(\omega)$ has a spectral peak at $\omega_o$ ($4\omega_o-3\omega_o$, $5\omega_o-4\omega_o$). For a typical periodic signal, the spectral peak at the fundamental frequency is likely to be the most prominent.

The above discussion also applies to complex signals. For a complex signal x(n), the Fourier transform of $|x(n)|^2$ is:

$$\sum_{n=-\infty}^{\infty} |x(n)|^2 e^{-j\omega n} = \frac{1}{2\pi}\int_{u=-\pi}^{\pi} X(\omega+u)X^*(u)du.$$

This is an autocorrelation of $X(\omega)$ with $X^*(\omega)$, and also has the property that spectral peaks separated by $n\omega_o$ produce peaks at $n\omega_o$.

Even though $|x(n)|$, $|x(n)|^a$ a for some real "a", and log $|x(n)|$ are not the same as $|x(n)|^2$, the discussion above for $|x(n)|^2$ applies approximately at the qualitative level.

For example, for $|x(n)|=y(n)^{0.5}$, where $y(n)=|x(n)|^2$, a Taylor series expansion of y(n) can be expressed as:

$$|x(n)| = \sum_{k=0}^{\infty} c_k y^k(n).$$

Because multiplication is associative, the Fourier transform of the signal $y^k(n)$ is $Y(\omega)$ convolved with the Fourier transform of $y^{k-1}(n)$. The behavior for nonlinear operations other than $|x(n)|^2$ can be derived from $|x(n)|^2$ by observing the behavior of multiple convolutions of $Y(\omega)$ with itself. If $Y(\omega)$ has peaks at $n\omega_o$, then multiple convolutions of $Y(\omega)$ with itself will also have peaks at $n\omega_o$.

As shown, nonlinear operations emphasize the fundamental frequency of a periodic signal, and are particularly useful when the periodic signal includes significant energy at higher harmonics. However, the presence of the nonlinearity can degrade performance in some cases. For example, performance may be degraded when speech signal s(n) is divided into multiple bands $s_i(n)$ using bandpass filters, where $s_i(n)$ denotes the result of bandpass filtering using the ith bandpass filter. If a single harmonic of the fundamental frequency is present in the pass band of the ith filter, the output of the filter is:

$$S_i(n)=A_k e^{j(\omega_k+\theta_k)}$$

where $\omega_k$ is the frequency, $\theta_k$ is the phase, and $A_k$ is the amplitude of the harmonic. When a nonlinearity such as the absolute value is applied to $s_i(n)$ to produce a value $y_i(n)$, the result is:

$$y_i(n)=|s_i(n)|=|A_k|$$

so that the frequency information has been completely removed from the signal $y_i(n)$. Removal of this frequency information can reduce the accuracy of parameter estimates.

The hybrid technique of the invention provides significantly improved parameter estimation performance in cases for which the nonlinearity reduces the accuracy of parameter estimates while maintaining the benefits of the nonlinearity in the remaining cases. As described above, the hybrid technique includes combining parameter estimates based on the signal after the nonlinearity has been applied ($y_i(n)$) with parameter estimates based on the signal before the nonlinearity is applied ($s_i(n)$ or $s(n)$). The two approaches produce parameter estimates along with an indication of the probability of correctness of these parameter estimates. The parameter estimates are then combined giving higher weight to estimates with a higher probability of being correct.

In another aspect, generally, the invention features the application of smoothing techniques to the voiced/unvoiced parameters. Voiced/unvoiced parameters can be binary or continuous functions of time and/or frequency. Because these parameters tend to be smooth functions in at least one direction (positive or negative) of time or frequency, the estimates of these parameters can benefit from appropriate application of smoothing techniques in time and/or frequency.

The invention also features an improved technique for estimating voiced/unvoiced parameters. In vocoders such as linear prediction vocoders, homomorphic vocoders, channel vocoders, sinusoidal transform coders, multiband excitation vocoders, and IMBE (TM) vocoders, a pitch period n (or equivalently a fundamental frequency) is selected. Thereafter, a function $f_i(n)$ is then evaluated at the selected pitch period (or fundamental frequency) to estimate the ith voiced/unvoiced parameter. However, for some speech signals, evaluation of this function only at the selected pitch period will result in reduced accuracy of one or more voiced/unvoiced parameter estimates. This reduced accuracy may result from speech signals that are more periodic at a multiple of the pitch period than at the pitch period, and may be frequency dependent so that only certain portions of the spectrum are more periodic at a multiple of the pitch period. Consequently, the voiced/unvoiced parameter estimation accuracy can be improved by evaluating the function $f_i(n)$ at the pitch period n and at its multiples, and thereafter combining the results of these evaluations.

In another aspect, the invention features an improved technique for estimating the fundamental frequency or pitch period. When the fundamental frequency $\omega_o$ (or pitch period $n_o$) is estimated, there may be some ambiguity as to whether $\omega_o$ or a submultiple or multiple of $\omega_o$ is the best choice for the fundamental frequency. Since the fundamental frequency tends to be a smooth function of time for voiced speech, predictions of the fundamental frequency based on past estimates can be used to resolve ambiguities and improve the fundamental frequency estimate.

Other features and advantages of the invention will be apparent from the following description of the preferred embodiments and from the claims.

DESCRIPTION OF THE PREFERRED EMBODIMENTS

FIGS. 1–12 show the structure of a system for estimating excitation parameters, the various blocks and units of which are preferably implemented with software.

Figure 1:
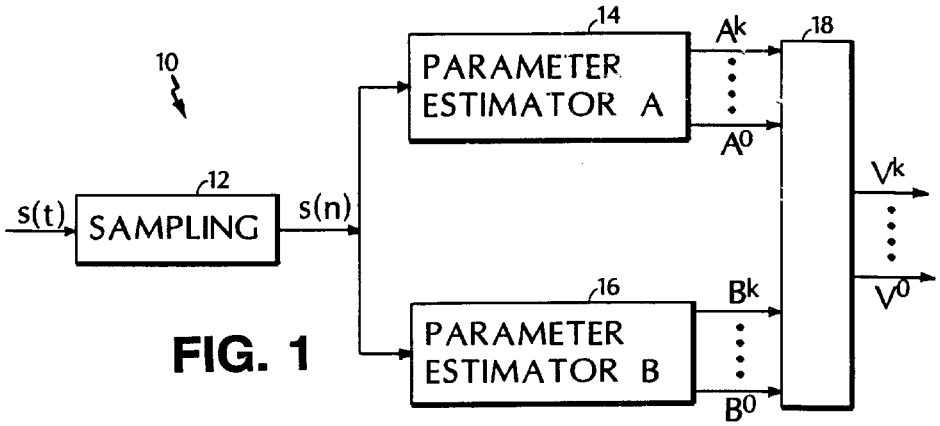
FIG. 1 is a block diagram of a system for determining whether frequency bands of a signal are voiced or unvoiced.

With reference to FIG. 1, a voiced/unvoiced determination system 10 includes a sampling unit 12 that samples an analog speech signal s(t) to produce a speech signal s(n). For typical speech coding applications, the sampling rate ranges between six kilohertz and ten kilohertz.

Speech signal s(n) is supplied to a first parameter estimator 14 that divides the speech signal into k+1 bands and produces a first set of preliminary voiced/unvoiced ("V/UV") parameters ($A^0$ to $A^K$) corresponding to a first estimate as to whether the signals in the bands are voiced or unvoiced. Speech signal s(n) is also supplied to a second parameter estimator 16 that produces a second set of preliminary V/UV parameters ($B^0$ to $B^K$) that correspond to a second estimate as to whether the signals in the bands are voiced or unvoiced. The two sets of preliminary V/UV parameters are combined by a combination block 18 to produce a set of V/UV parameters ($V^0$ to $V^K$).

Figure 2:
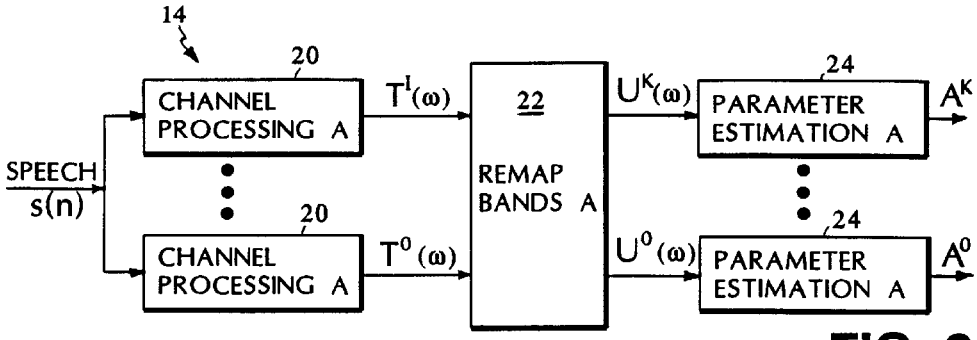
FIG. 2 is a block diagram of a parameter estimation unit of the system of FIG. 1.

With reference to FIG. 2, first parameter estimator 14 produces the first voiced/unvoiced estimate using a frequency domain approach. Channel processing units 20 in first parameter estimator 14 divide speech signal s(n) into at least two frequency bands and process the frequency bands to produce a first set of frequency band signals, designated as $T^O(\omega)$ . . $T_I(\omega)$. As discussed below, channel processing units 20 are differentiated by the parameters of a bandpass filter used in the first stage of each channel processing unit 20. In the described embodiment, there are sixteen channel processing units (I equals 15).

A remap unit 22 transforms the first set of frequency band signals to produce a second set of frequency band signals, designated as $U^O(\omega)$ . . $U^K(\omega)$. In the described embodiment, there are eight frequency band signals in the second set of frequency band signals (K equals 7). Thus, remap unit 22 maps the frequency band signals from the sixteen channel processing units 20 into eight frequency band signals. Remap unit 20 does so by combining consecutive pairs of frequency band signals from the first set into single frequency band signals in the second set. For example, $T^O(\omega)$ and $T^1(\omega)$ are combined to produce $U^O(\omega)$, and $T^{14}(\omega)$ and $T^{15}(\omega)$ are combined to produce $U^7(\omega)$. Other approaches to remapping could also be used.

Next, voiced/unvoiced parameter estimation units 24, each associated with a frequency band signal from the second set, produce preliminary V/UV parameters $A^0$ to $A^K$ by computing a ratio of the voiced energy in the frequency band at an estimated fundamental frequency $\omega_o$ to the total energy in the frequency band and subtracting this ratio from 1:

$$A^k = 1.0 - E^k_v(\omega_o)E^k_t.$$

The voiced energy in the frequency band is computed as:

$$E_v^k(\omega_o) = \sum_{n=1}^{N} \sum_{\omega_m \in I_n} U^k(\omega_m)$$

where $$I_n = [(n-0.25)\omega_o, (n+0.25)\omega_o],$$

and N is the number of harmonics of the fundamental frequency $\omega_o$ being considered. V/UV parameter estimation units 24 determine the total energy of their associated frequency band signals as:

$$E_T^k = \sum_{\forall \omega_m > 0.5\omega_o} U^k(\omega_m).$$

The degree to which the frequency band signal is voiced varies indirectly with the value of the preliminary V/UV parameter. Thus, the frequency band signal is highly voiced when the preliminary V/UV parameter is near zero and is highly unvoiced when the parameter is greater than or equal to one half.

Figure 3:
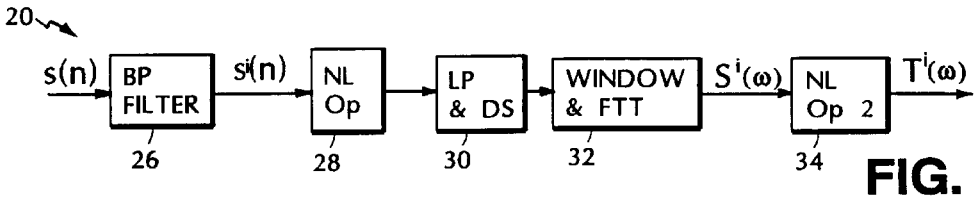
FIG. 3 is a block diagram of a channel processing unit of the parameter estimation unit of FIG. 2.

With reference to FIG. 3, when speech signal s(n) enters a channel processing unit 20, components $s_i(n)$ belonging to a particular frequency band are isolated by a bandpass filter 26. Bandpass filter 26 uses downsampling to reduce computational requirements, and does so without any significant impact on system performance. Bandpass filter 26 can be implemented as a Finite Impulse Response (FIR) or Infinite Impulse Response (IIR) filter, or by using an FFT. In the described embodiment, bandpass filter 26 is implemented using a thirty two point real input FFT to compute the outputs of a thirty two point FIR filter at seventeen frequencies, and achieves a downsampling factor of S by shifting the input by S samples each time the FFT is computed. For example, if a first FFT used samples one through thirty two, a downsampling factor of ten would be achieved by using samples eleven through forty two in a second FFT.

A first nonlinear operation unit 28 then performs a nonlinear operation on the isolated frequency band $s_i$ (n) to emphasize the fundamental frequency of the isolated frequency band $s_i(n)$. For complex values of $s_i$ (n) (i greater than zero), the absolute value, $|s_i(n)|$, is used. For the real value of $s^o(n)$, $s^o(n)$ is used if $s^o(n)$ is greater than zero and zero is used if $s^o(n)$ is less than or equal to zero.

The output of nonlinear operation unit 28 is passed through a lowpass filtering and downsampling unit 30 to reduce the data rate and consequently reduce the computational requirements of later components of the system. Lowpass filtering and downsampling unit 30 uses an FIR filter computed every other sample for a downsampling factor of two.

A windowing and FFT unit 32 multiplies the output of lowpass filtering and downsampling unit 30 by a window and computes a real input FFT, $S^i(\omega)$, of the product. Typically, windowing and FFT unit 32 uses a Hamming window and a real input FFT.

Finally, a second nonlinear operation unit 34 performs a nonlinear operation on $S_i$ ($\omega$) to facilitate estimation of voiced or total energy and to ensure that the outputs or channel processing units 20, $T^i(\omega)$, combine constructively if used in fundamental frequency estimation. The absolute value squared is used because it makes all components of $T^i(\omega)$ real and positive.

Figure 4:
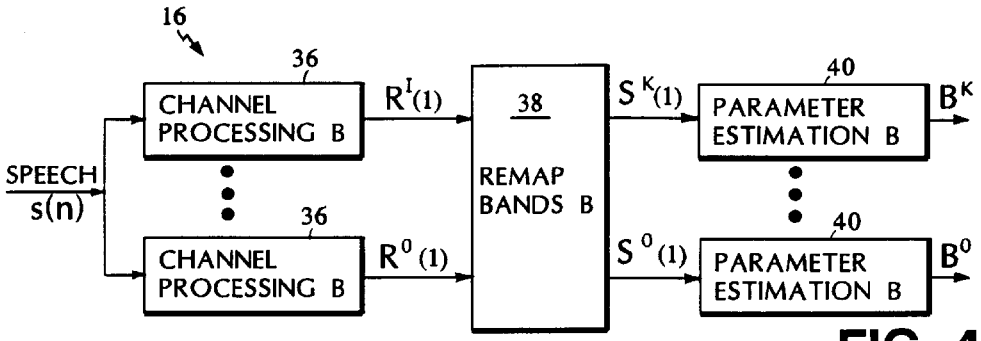
FIG. 4 is a block diagram of a parameter estimation unit of the system of FIG. 1.

With reference to FIG. 4, second parameter estimator 16 produces the second preliminary V/UV estimates using a sinusoid detector/estimator. Channel processing units 36 in second parameter estimator 16 divide speech signal s(n) into at least two frequency bands and process the frequency bands to produce a first set of signals, designated as $R^o(i)$ . . $R^I(1)$ Channel processing units 36 in differentiated by the parameters of a bandpass filter used in the first stage of each channel processing unit 36. In the described embodiment, there are sixteen channel processing units (I equals 15). The number of channels (value of I) in FIG. 4 does not have to equal the number of channels (value of I) in FIG. 2.

A remap unit 38 transforms the first set of signals, to produce a second set of signals, designated as $S^O(1)$ . . $S^K(1)$. The remap unit can be an identity system. In the described embodiment, there are eight signals in the second set of signals (K equals 7). Thus, remap unit 38 maps the signals from the sixteen channel processing units 36 into eight signals. Remap unit 38 does so by combining consecutive pairs of signals from the first set into single signals in the second set. For example, $R^0(1)$ and $R^1(1)$ are combined to produce $S_0(1)$, and $R^{14}(1)$ and $R^{15}(1)$ are combined to produce $S^7(1)$. Other approaches to remapping could also be used.

Next, V/UV parameter estimation units 40, each associated with a signal from the second set, produce preliminary V/UV parameters $B^0$ to $B^K$ by computing a ratio of the sinusoidal energy in the signal to the total energy in the signal and subtracting this ratio from 1:

$$B^k = 1.0 - S^k(1)/S^k(0).$$

Figure 5:
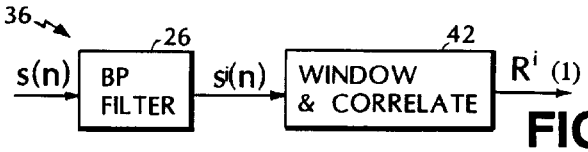
FIG. 5 is a block diagram of a channel processing unit of the parameter estimation unit of FIG. 4.

With reference to FIG. 5, when speech signal s(n) enters a channel processing unit 36, components $s_i$ (n) belonging to a particular frequency band are isolated by a bandpass filter 26 that operates identically to the bandpass filters of channel processing units 20 (see FIG. 3). It should be noted that, to reduce computation requirements, the same bandpass filters may be used in channel processing units 20 and 36, with the outputs of each filter being supplied to a first nonlinear operation unit 28 of a channel processing unit 20 and a window and correlate unit 42 of a channel processing unit 36.

A window and correlate unit 42 then produces two correlation values for the isolated frequency band $s_i$ (n). The first value, $R_i$ (0), provides a measure of the total energy in the frequency band:

$$R^i(0) = \left[ \frac{1}{2} \sum_{n=0}^{N-1} [|s^i(n)|^2 + |s^i(n+S)|^2] \right]^2$$

where N is related to the size of the window and typically defines an interval of 20 milliseconds and S is the number of samples by which the bandpass filter shifts the input speech samples. The second value, $R_i$ (1), provides a measure of the sinusoidal energy in the frequency band:

$$R^i(1) = \left| \sum_{n=0}^{N-1} s^i(n+S)s^{*i}(n) \right|^2.$$

Combination block 18 produces voiced/unvoiced parameters $V^O$ to $V^K$ by selecting the minimum of a preliminary V/UV parameter from the first set and a function of a preliminary V/UV parameter from the second set. In particular, combination block produces the voiced/unvoiced parameters as:

$$V^k=\min(A^k f_B(B^k))$$

where $$f_B(B_k)=B_k+\alpha(k)\beta(\omega_o),$$

$$\beta(\omega_o)=1.0, \text{ when } \omega_o \geqq 2\pi/60.0,$$

or $$2\pi/(60\omega_o), \text{ when } \omega_o<2\pi/60.0$$

and $\alpha(k)$ is an increasing function of k. Because a preliminary V/UV parameter having a value close to zero has a higher probability of being correct than a preliminary V/UV parameter having a larger value, the selection of the minimum value results in the selection of the value that is most likely to be correct.

Figure 6:
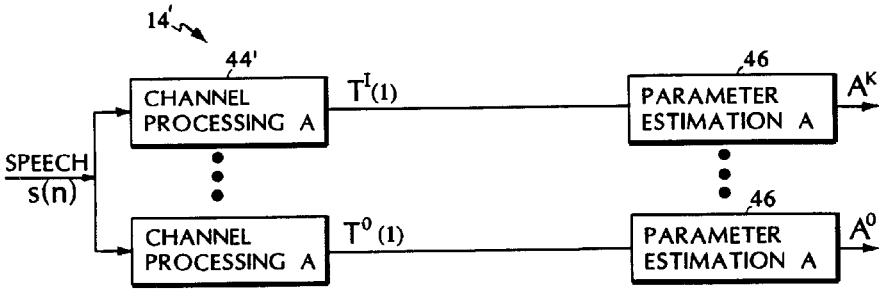
FIG. 6 is a block diagram of a parameter estimation unit of the system of FIG. 1.

With reference to FIG. 6, in another embodiment, a first parameter estimator 14' produces the first preliminary V/UV estimate using an autocorrelation domain approach. Channel processing units 44 in first parameter estimator 14' divide speech signal s(n) into at least two frequency bands and process the frequency bands to produce a first set of frequency band signals, designated as $T_O(1) \ldots T_K(1)$. There are eight channel processing units (K equals 7) and no remapping unit is necessary.

Next, voiced/unvoiced (V/UV) parameter estimation units 46, each associated with a channel processing unit 44, produce preliminary V/UV parameters $A_O$ to $A^K$ by computing a ratio of the voiced energy in the frequency band at an estimated pitch period $n_o$ to the total energy in the frequency band and subtracting this ratio from 1:

$$A^k=1.0-E^k_v(n_o)/E^k_t.$$

The voiced energy in the frequency band is computed as:

$$E^k_v(n_o)=C(n_o)T^k(n_o)$$

where $$C(n_o)=\frac{1}{\sum_{n=0}^{N-1} w(n)w(n+n_o)}$$

N is the number of samples in the window and typically has a value of 101, and $C(n_o)$ compensates for the window roll-off as a function of increasing autocorrelation lag. For non-integer values of $n_o$, the voiced energy at the nearest three values of n are used with a parabolic interpolation method to obtain the voiced energy for $n_o$. The total energy is determined as the voiced energy for $n_o$ equal to zero.

Figure 7:
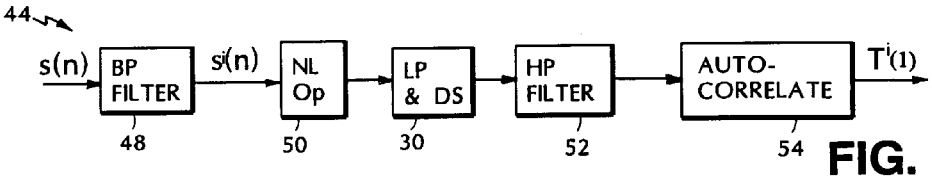
FIG. 7 is a block diagram of a channel processing unit of the parameter estimation unit of FIG. 6.

With reference to FIG. 7, when speech signal s(n) enters a channel processing unit 44, components $s_i(n)$ belonging to a particular frequency band are isolated by a bandpass filter 48. Bandpass filter 48 uses downsampling to reduce computational requirements, and does so without any significant impact on system performance. Bandpass filter 48 can be implemented as a Finite Impulse Response (FIR) or Infinite Impulse Response (IIR) filter, or by using an FFT. A downsampling factor of S is achieved by shifting the input speech samples by S each time the filter outputs are computed.

A nonlinear operation unit 50 then performs a nonlinear operation on the isolated frequency band $s^i(n)$ to emphasize the fundamental frequency of the isolated frequency band $s^i(n)$. For complex values of $s_i(n)$ (i greater than zero), the absolute value, $|s^i(n)|$, is used. For the real value of $s^O(n)$, no nonlinear operation is performed.

The output of nonlinear operation unit 50 is passed through a highpass filter 52, and the output of the highpass filter is passed through an autocorrelation unit 54. A 101 point window and is used, and, to reduce computation, the autocorrelation is only computed at a few samples nearest the pitch period.

With reference again to FIG. 4, second parameter estimator 16 may also use other approaches to produce the second voiced/unvoiced estimate. For example, well-known techniques such as using the height of the peak of the cepstrum, using the height of the peak of the autocorrelation of a linear prediction coder residual, MBE model parameter estimation methods, or IMBE (TM) model parameter estimation methods may be used. In addition, with reference again to FIG. 5, window and correlate unit 42 may produce autocorrelation values for the isolated frequency band $s^i(n)$ as:

$$R^i(1)=Re\left[\sum_n s^i(n+1)w(n+1)s^{*i}(n)w(n)\right]$$

where w (n) is the window. With this approach, combination block 18 produces the voiced/unvoiced parameters as:

$$V^k=\min(A^k, B_k).$$

The fundamental frequency may be estimated using a number of approaches. First, with reference to FIG. 8, a fundamental frequency estimation unit 56 includes a combining unit 58 and an estimator 60. Combining unit 58 sums the $T^i(\omega)$ outputs of channel processing units 20 (FIG. 2) to produce $X(\omega)$. In an alternative approach, combining unit 58 could estimate a signal-to-noise ratio (SNR) for the output of each channel processing unit 20 and weigh the various outputs so that an output with a higher SNR contributes more to $X(\omega)$ than does an output with a lower SNR.

Estimator 60 then estimates the fundamental frequency ($\omega_o$) by selecting a value for $\omega_o$ that maximizes $X(\omega)$ over an interval from $\omega_{min}$ to $\omega_{max}$. Since $X(\omega)$ is only available at discrete samples of $\omega$, parabolic interpolation of $X(\omega)$ near $\omega_o$ is used to improve accuracy of the estimate. Estimator 60 further improves the accuracy of the fundamental estimate by combining parabolic estimates near the peaks of the N harmonics of $\omega_o$ within the bandwidth of $X(\omega)$.

Once an estimate of the fundamental frequency is determined, the voiced energy $E^v(\omega_o)$ is computed as:

$$E^v(\omega_o)=\sum_{n=1}^{N}\sum_{\omega_m \in I_n} X(\omega_m)$$

where $$I_n=[(n-0.25)\omega_o, (n+0.25)\omega_o].$$

Thereafter, the voiced energy $E^v(0.5\omega_o)$ is computed and compared to $E^v(\omega_o)$ to select between $\omega_o$ and $0.5\omega_o$ as the final estimate of the fundamental frequency.

Figure 9:
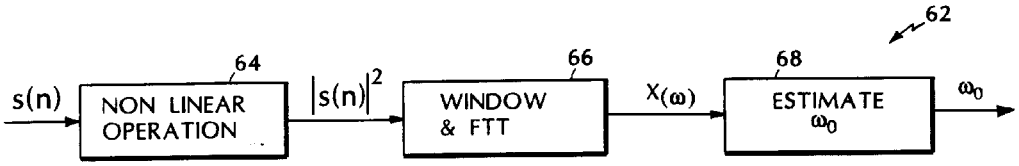

With reference to FIG. 9, an alternative fundamental frequency estimation unit 62 includes a nonlinear operation unit 64, a windowing and Fast Fourier Transform (FFT) unit 66, and an estimator 68. Nonlinear operation unit 64 performs a nonlinear operation, the absolute value squared, on s(n) to emphasize the fundamental frequency of s(n) and to facilitate determination of the voiced energy when estimating $\omega_o$.

Windowing and FFT unit 66 multiplies the output of nonlinear operation unit 64 to segment it and computes an FFT, $X(\omega)$, of the resulting product. Finally, estimator 68, which works identically to estimator 60, generates an estimate of the fundamental frequency.

Figure 10:
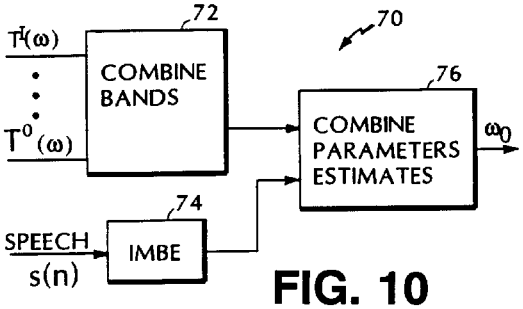
FIGS. 8–10 are block diagrams of systems for determining the fundamental frequency of a signal.
Figure 8:
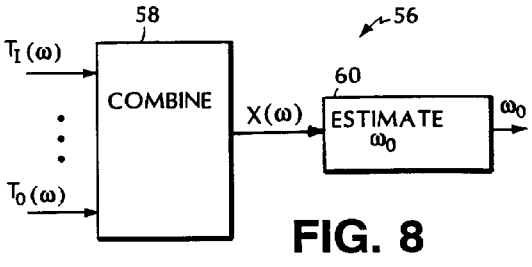

With reference to FIG. 10, a hybrid fundamental frequency estimation unit 70 includes a band combination and estimation unit 72, an IMBE estimation unit 74 and an estimate combination unit 76. Band combination and estimation unit 70 combines the outputs of channel processing units 20 (FIG. 2) using simple summation or a signal-to-noise ratio (SNR) weighting where bands with higher SNRs are given higher weight in the combination. From the combined signal ($U(\omega)$), unit 72 estimates a fundamental frequency and a probability that the fundamental frequency is correct. Unit 72 estimates the fundamental frequency by choosing the frequency that maximizes the voiced energy ($E_v(\omega_o)$) from the combined signal, which is determined as:

$$E_v(\omega_o) = \sum_{n=1}^{N} \sum_{\omega_m \in I_n} U(\omega_m)$$

where $$I_n=[(n-0.25)\omega_o, (n+0.25)\omega_o].$$

and N is the number of harmonics of the fundamental frequency. The probability that $\omega_o$ is correct is estimated by comparing $E_v(\omega_o)$ to the total energy $E_t$, which is computed as:

$$E_t = \sum_{\forall \omega_m > 0.5\omega_o} U(\omega_m).$$

When $E_v(\omega_o)$ is close to $E_t$, the probability estimate is near one. When $E_v(\omega_o)$ is close to one half of $E_t$, the probability estimate is near zero.

IMBE estimation unit 74 uses the well known IMBE technique, or a similar technique, to produce a second fundamental frequency estimate and probability of correctness. Thereafter, estimate combination unit 76 combines the two fundamental frequency estimates to produce the final fundamental frequency estimate. The probabilities of correctness are used so that the estimate with higher probability of correctness is selected or given the most weight.

Figure 11:
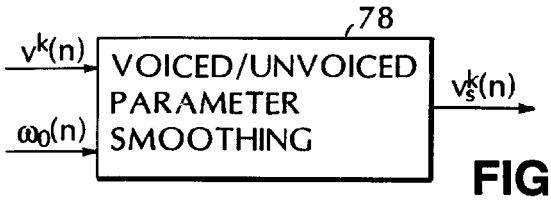
FIG. 11 is a block diagram of voiced/unvoiced parameter smoothing unit.

With reference to FIG. 11, a voiced/unvoiced parameter smoothing unit 78 performs a smoothing operation to remove voicing errors that might result from rapid transitions in the speech signal. Unit 78 produces a smoothed voiced/unvoiced parameter as:

$$v^k_s(n)=1.0, \text{ when } v^k(n-1)v^k(n+1)=1$$

and $v^k(n)$, otherwise where the voiced/unvoiced parameters equal zero for unvoiced speech and one for voiced speech. When the voiced/unvoiced parameters have continuous values, with a value near zero corresponding to highly voiced speech, unit 78 produces a smoothed voiced/unvoiced parameter that is smoothed in both the time and frequency domains:

$$v^k_s(n)=\lambda^k(n)\min(v^k(n), \alpha^k(n), \beta^k(n), \gamma^k(n))$$

where $$\alpha^k(n)=2v^{k+1}(n), \text{ when } k=0, 1, \ldots, K-1,$$

or $\infty$, when k=K;

$$\beta^k(n)=2v^{k-1}(n), \text{ when } k=2, 3, \ldots, K,$$

or $\infty$, when k=0, 1;

$$\gamma^k(n)=0.25v^{k-1}(n)+0.5v^k(n)+0.25v^{k-1}(n), \text{ when } k=1, 2, \ldots, K-1,$$

or $\infty$, when k=0, K;

$$\lambda^k(n)=0.8, \text{ when } v^k_s(n-1)<T^k(n-1)$$

and $$|\omega_o(n)-\omega_o(n-1)|<0.25|\omega_o(n)|,$$

or 1, otherwise;

and $T^k(n)$ is a threshold value that is a function of time and frequency.

Figure 12:
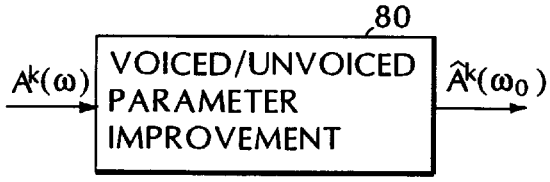
FIG. 12 is a block diagram of voiced/unvoiced parameter improvement unit.

With reference to FIG. 12, a voiced/unvoiced parameter improvement unit 80 produces improved voiced/unvoiced parameters by comparing the voiced/unvoiced parameter produced when the estimated fundamental frequency equals $\omega_o$ to a voiced/unvoiced parameter produced when the estimated fundamental frequency equals one half of $\omega_o$ and selecting the parameter having the lowest value. In particular, voiced/unvoiced parameter improvement unit 80 produces improved voiced/unvoiced parameters as:

$$A_k(\omega_o)=\min(A_k(\omega_o), A_k(0.5\omega_o))$$

where $$A_k(\omega)=1.0-E^k_v(\omega)/E^k_t.$$

Figure 13:
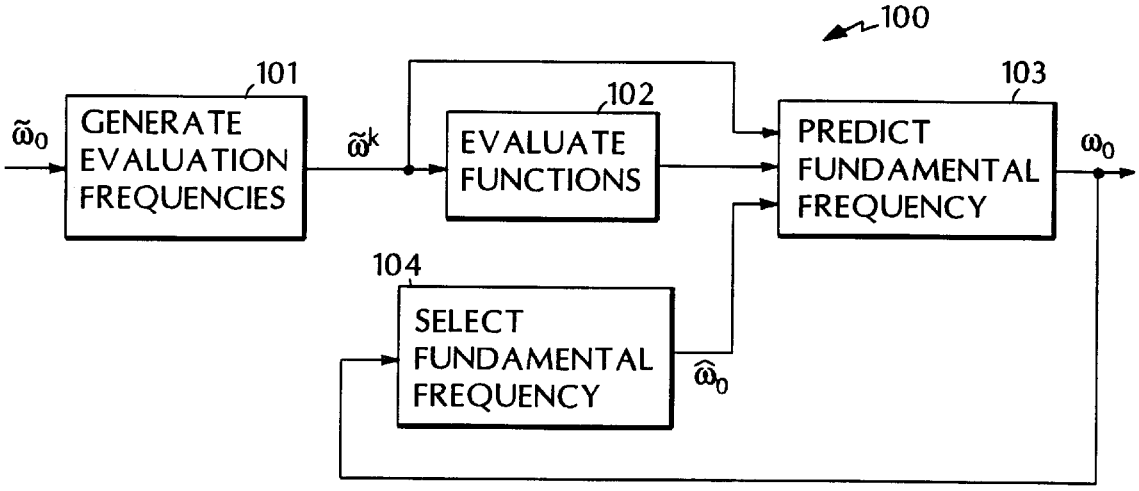
FIG. 13 is a block diagram of a fundamental frequency improvement unit.

With reference to FIG. 13, an improved estimate of the fundamental frequency ($\omega_o$) is generated according to a procedure 100. The initial fundamental frequency estimate ($\omega_o$) is generated according to one of the procedures described above and is used in step 101 to generate a set of evaluation frequencies $\omega_k$. The evaluation frequencies are typically chosen to be near the integer submultiples and multiples of $\omega$. Thereafter, functions are evaluated at this set of evaluation frequencies (step 102). The functions that are evaluated typically consist of the voiced energy function $E_v(\omega^k)$ and the normalized frame error $E_f(\omega^k)$. The normalized frame error is computed as $$E_f(\overline{\omega}^k)=1.0-E_v(\overline{\omega}^k)/E_t(\overline{\omega}^k).$$

The final fundamental frequency estimate is then selected (step 103) using the evaluation frequencies, the function values at the evaluation frequencies, the predicted fundamental frequency (described below), the final fundamental frequency estimates from previous frames, and the above function values from previous frames. When these inputs indicate that one evaluation frequency has a much higher probability of being the correct fundamental frequency than the others, then it is chosen. Otherwise, if two evaluation frequencies have similar probability of being correct and the normalized error for the previous frame is relatively low, then the evaluation frequency closest to the final fundamental frequency from the previous frame is chosen. Otherwise, it two evaluation frequencies have similar probability of being correct, then the one closest to the predicted fundamental frequency is chosen. The predicted fundamental frequency for the next frame is generated (step 104) using the final fundamental frequency estimates from the current and previous frames, a delta fundamental frequency, and normalized frame errors computed at the final fundamental frequency estimate for the current frame and previous frames. The delta fundamental frequency is computed from the frame to frame difference in the final fundamental frequency estimate when the normalized frame errors for these frames are relatively low and the percentage change in fundamental frequency is low, otherwise, it is computed from previous values. When the normalized error for the current frame is relatively low, the predicted fundamental for the current frame is set to the final fundamental frequency. The predicted fundamental for the next frame is set to the sum of the predicted fundamental for the current frame and the delta fundamental frequency for the current frame.

Other embodiments are within the following claims.

What is claimed is:

1. A method of analyzing a digitized speech signal to determine excitation parameters for the digitized speech signal, comprising:

dividing the digitized speech signal into one or more frequency band signals;

determining a first preliminary excitation parameter using a first method that includes performing a nonlinear operation on at least one of the frequency band signals to produce at least one modified frequency band signal and determining the first preliminary excitation parameter using the at least one modified frequency band signal;

determining at least a second preliminary excitation parameter using at least a second method different from the said first method; and using the first and at least a second preliminary excitation parameters to determine an excitation parameter for the digitized speech signal.

2. The method of claim 1, wherein the determining and using steps are performed at regular intervals of time.

3. The method of claim 1, wherein the digitized speech signal is analyzed as a step in encoding speech.

4. The method of claim 1, wherein the excitation parameter comprises a voiced/unvoiced parameter for at least one frequency band.

5. The method of claim 4, further comprising determining a fundamental frequency for the digitized speech signal.

6. The method of claim 4, wherein the first preliminary excitation parameters comprises a first voiced/unvoiced parameter for the at least one modified frequency band signal, and wherein the first determining step includes determining the first voiced/unvoiced parameter by comparing voiced energy in the modified frequency band signal to total energy in the modified frequency band signal.

7. The method of claim 6, wherein the voiced energy in the modified frequency band signal corresponds to the energy associated with an estimated fundamental frequency for the digitized speech signal.

8. The method of claim 6, wherein the voiced energy in the modified frequency band signal corresponds to the energy associated with an estimated pitch period for the digitized speech signal.

9. The method of claim 6, wherein the second preliminary excitation parameter includes a second voiced/unvoiced parameter for the at least one frequency band signal, and wherein the second determining step includes determining the second voiced/unvoiced parameter by comparing sinusoidal energy in the at least one frequency band signal to total energy in the at least one frequency band signal.

10. The method of claim 6, wherein the second preliminary excitation parameter includes a second voiced/unvoiced parameter for the at least one frequency band signal, and wherein the second determining step includes determining the second voiced/unvoiced parameter by autocorrelating the at least one frequency band signal.

11. The method of claim 4, wherein the voiced/unvoiced parameter has values that vary over a continuous range.

12. The method of claim 1, wherein the using step emphasizes the first preliminary excitation parameter over the second preliminary excitation parameter in determining the excitation parameter for the digitized speech signal when the first preliminary excitation parameter has a higher probability of being correct than does the second preliminary excitation parameter.

13. The method of claim 1, further comprising smoothing the excitation parameter to produce a smoothed excitation parameter.

14. A method of synthesizing speech using the excitation parameters, where the excitation parameters were estimated using the method in claim 1.

15. The method of claim 1, wherein at least one of the second methods uses at least one of the frequency band signals without performing the said nonlinear operation.

16. A method of analyzing a digitized speech signal to determine excitation parameters for the digitized speech signal, comprising the steps of:

dividing the digitized speech signal into one or more frequency band signals;

determining a preliminary excitation parameter using a method that includes performing a nonlinear operation on at least one of the frequency band signals to produce at least one modified frequency band signal and determining the preliminary excitation parameter using the at least one modified frequency band signal; and smoothing the preliminary excitation parameter to produce an excitation parameter.

17. The method of claim 16, wherein the digitized speech signal is analyzed as a step in encoding speech.

18. The method of claim 16, wherein the preliminary excitation parameters include a preliminary voiced/unvoiced parameter for at least one frequency band and the excitation parameters include a voiced/unvoiced parameter for at least one frequency band.

19. The method of claim 18, wherein the excitation parameters include a fundamental frequency.

20. The method of claim 18, wherein the digitized speech signal is divided into frames and the smoothing step makes the voiced/unvoiced parameter of a frame more voiced than the preliminary voiced/unvoiced parameter when voiced/unvoiced parameters of frames that precede or succeed the frame by less than a predetermined number of frames are voiced.

21. The method of claim 18, wherein the smoothing step makes the voiced/unvoiced parameter of a frequency band more voiced than the preliminary voiced/unvoiced parameter when voiced/unvoiced parameters of a predetermined number of adjacent frequency bands are voiced.

22. The method of claim 18, wherein the digitized speech signal is divided into frames and the smoothing step makes the voiced/unvoiced parameter of a frame and frequency band more voiced than the preliminary voiced/unvoiced parameter when voiced/unvoiced parameters of frames that precede or succeed the frame by less than a predetermined number of frames and voiced/unvoiced parameters of a predetermined number of adjacent frequency bands are voiced.

23. The method of claim 18, wherein the voiced/unvoiced parameter is permitted to have values that vary over a continuous range.

24. The method of claim 16, wherein the smoothing step is performed as a function of time.

25. The method of claim 16, wherein the smoothing step is performed as a function of both time and frequency.

26. A method of synthesizing speech using the excitation parameters, where the excitation parameters were estimated using the method in claim 16.

27. A method of analyzing a digitized speech signal to determine excitation parameters for the digitized speech signal, comprising the steps of:

estimating a fundamental frequency for the digitized speech signal;

evaluating a voiced/unvoiced function using the estimated fundamental frequency to produce a first preliminary voiced/unvoiced parameter;

evaluating the voiced/unvoiced function at least using one other frequency derived from the estimated fundamental frequency to produce at least one other preliminary voiced/unvoiced parameter; and combining the first and at least one other preliminary voiced/unvoiced parameters to produce a voiced/unvoiced parameter.

28. The method of claim 27, wherein the said at least one other frequency is derived from the said estimated fundamental frequency as a multiple or submultiple of the said estimated fundamental frequency.

29. The method of claim 27, wherein the digitized speech signal is analyzed as a step in encoding speech.

30. A method of synthesizing speech using the excitation parameters, where the excitation parameters were estimated using the method in claim 27.

31. The method of claim 27, wherein the combining step includes choosing the first preliminary voiced/unvoiced parameter as the voiced/unvoiced parameter when the first preliminary voiced/unvoiced parameter indicates that the digitized speech signal is more voiced than does the second preliminary voiced/unvoiced parameter.

32. A method of analyzing a digitized speech signal to determine a fundamental frequency estimate for the digitized speech signal, comprising the steps of:

determining a predicted fundamental frequency estimate from previous fundamental frequency estimates;

determining an initial fundamental frequency estimate;

evaluating an error function at the initial fundamental frequency estimate to produce a first error function value;

evaluating the error function at at least one other frequency derived from the initial fundamental frequency estimate to produce at least one other error function value;

selecting a fundamental frequency estimate using the predicted fundamental frequency estimate, the initial fundamental frequency estimate, the first error function value, and the at least one other error function value.

33. The method of claim 32, wherein the said at least one other frequency is derived from the said estimated fundamental frequency as a multiple or submultiple of the said estimated fundamental frequency.

34. The method of claim 32, wherein the predicted fundamental frequency is determined by adding a delta factor to a previous predicted fundamental frequency.

35. The method of claim 34, wherein the delta factor is determined from previous first and at least one other error function values, the previous predicted fundamental frequency, and a previous delta factor.

36. A method of synthesizing speech using a fundamental frequency, where the fundamental frequency was estimated using the method in claim 32.

37. A system for analyzing a digitized speech signal to determine excitation parameters for the digitized speech signal, comprising:

means for dividing the digitized speech signal into one or more frequency band signals;

means for determining a first preliminary excitation parameter using a first method that includes performing a nonlinear operation on at least one of the frequency band signals to produce at least one modified frequency band signal and determining the first preliminary excitation parameter using the at least one modified frequency band signal;

means for determining a second preliminary excitation parameter using a second method that is different from the above said first method; and means for using the first and second preliminary excitation parameters to determine an excitation parameter for the digitized speech signal.

38. A system for analyzing a digitized speech signal to determine excitation parameters for the digitized speech signal, comprising:

means for dividing the digitized speech signal into one or more frequency band signals;

means for determining a preliminary excitation parameter using a method that includes performing a nonlinear operation on at least one of the frequency band signals to produce at least one modified frequency band signal and determining the preliminary excitation parameter using the at least one modified frequency band signal; and means for smoothing the preliminary excitation parameter to produce an excitation parameter.

39. A system for analyzing a digitized speech signal to determine modified excitation parameters for the digitized speech signal, comprising:

means for estimating a fundamental frequency for the digitized speech signal;

means for evaluating a voiced/unvoiced function using the estimated fundamental frequency to produce a first preliminary voiced/unvoiced parameter;

means for evaluating the voiced/unvoiced function using another frequency derived from the estimated fundamental frequency to produce a second preliminary voiced/unvoiced parameter; and means for combining the first and second preliminary voiced/unvoiced parameters to produce a voiced/unvoiced parameter.

40. A system for analyzing a digitized speech signal to determine a fundamental frequency estimate for the digitized speech signal, comprising:

means for determining a predicted fundamental frequency estimate from previous fundamental frequency estimates;

means for determining an initial fundamental frequency estimate;

means for evaluating an error function at the initial fundamental frequency estimate to produce a first error function value;

means for evaluating the error function at at least one other frequency derived from the initial fundamental frequency estimate to produce a second error function value;

means for selecting a fundamental frequency estimate using the predicted fundamental frequency estimate, the initial fundamental frequency estimate, the first error function value, and the second error function value.

41. A method of analyzing a digitized speech signal to determine a voiced/unvoiced function for the digitized speech signal, comprising:

dividing the digitized speech signal into at least two frequency band signals;

determining a first preliminary voiced/unvoiced function for at least two of the frequency band signals using a first method;

determining a second preliminary voiced/unvoiced function for at least two of the frequency band signals using a second method which is different from the above said first method; and using the first and second preliminary excitation parameters to determine a voiced/unvoiced function for at least two of the frequency band signals.

* * * * *